US006253432B1

(12) United States Patent
Peters et al.

(10) Patent No.: US 6,253,432 B1
(45) Date of Patent: Jul. 3, 2001

(54) METHOD OF SETTING SMALL OBJECTS IN MALLEABLE SHEET MATERIAL AND APPARATUS FOR CARRYING OUT THE METHOD

(75) Inventors: John Peters; John Grinnel, both of Birmingham (GB)

(73) Assignee: G & A Manufacturing Limited, Birmingham (GB)

( * ) Notice: Subject to any disclaimer, the term of this patent is extended or adjusted under 35 U.S.C. 154(b) by 0 days.

(21) Appl. No.: 09/341,073

(22) PCT Filed: Dec. 29, 1997

(86) PCT No.: PCT/GB97/03452

§ 371 Date: Aug. 5, 1999

§ 102(e) Date: Aug. 5, 1999

(87) PCT Pub. No.: WO98/29005

PCT Pub. Date: Jul. 9, 1998

(30) Foreign Application Priority Data

Jan. 3, 1997 (GB) ..... 9700051

(51) Int. Cl.[7] ..... B23P 5/00

(52) U.S. Cl. ..... 29/10; 29/513; 29/243.5; 29/243.58

(58) Field of Search ..... 29/10, 513, 243.5, 29/243.58; 63/26, 28; 72/479, 466.4

(56) References Cited

U.S. PATENT DOCUMENTS

| | | | | |
|---|---|---|---|---|
| 816,997 | * | 4/1906 | Pollard | 29/10 |
| 931,306 | * | 8/1909 | Hess | 29/10 |
| 3,839,770 | * | 10/1974 | Favre | 29/10 |
| 4,329,890 | | 5/1982 | Ferstenberg . | |
| 4,648,248 | * | 3/1987 | Raymona | 29/10 |
| 4,710,276 | * | 12/1987 | Kull | 29/10 |
| 4,793,045 | * | 12/1988 | Singer | 29/10 |

FOREIGN PATENT DOCUMENTS

| | | |
|---|---|---|
| 0 021 530 | 1/1981 | (EP) . |
| 0 569 661 | 11/1993 | (EP) . |
| 574 291 | 7/1924 | (FR) . |
| 1 148 364 | 12/1957 | (FR) . |
| 6-054706 | 5/1994 | (JP) . |

* cited by examiner

*Primary Examiner*—P. W. Echols
(74) *Attorney, Agent, or Firm*—Klauber & Jackson

(57) ABSTRACT

A method and apparatus for setting small gem stones in malleable material including precious metals such as gold sheets, so as to form lockets, pendants and other jewelry. Sheet material thinner than used in a completely hand-set operation is pressed to form a recess for the gem, and projections around the recess. The stone is deposited in the recess and the assembly is pressed in a jig, causing the projections to become deformed and form claws over the gem stone edge, setting it in the sheet.

7 Claims, 3 Drawing Sheets

METHOD OF SETTING SMALL OBJECTS IN MALLEABLE SHEET MATERIAL AND APPARATUS FOR CARRYING OUT THE METHOD

BACKGROUND OF THE INVENTION

1. Field of the Invention

This invention relates to a method and apparatus for setting small objects in malleable material, and it also relates to malleable sheet materials in which small objects are set.

2. Description of the Related Art

More specifically, but not exclusively the invention relates to the setting of gem stones in precious and semi-precious metal (such as gold and silver and their alloys) sheets, which are commonly used in the jewelry industry. Examples of items of jewelry incorporating set gem stones includes pendants, lockets, brooches and the like.

Although the following discussion relates predominantly to the setting of diamonds in gold, it will be appreciated that the invention has much wider application, and indeed may be used to set any stone or other suitably shaped and sized objects in any malleable sheet material. However, the invention has most suitable application in the jewelry industry as described hereinafter.

The setting of gem stones in precious metals such as gold and silver sheet is currently a highly skilled process. To set a stone, a hole smaller than the stone is drilled through the metal sheet in which the stone is to be set, and the upper edges of said hole are then chamfered inwardly of the hole such that the stone will seat correctly in an upright position. It should be pointed out that in most cases, the stones to be set are minute, and the sheet is as thin as possible (to keep the cost of the sheet down as much as possible) and thus the intricacy of the process is often extreme.

A metal scoop is used to gouge metal from the sheet around the hole in a desired pattern, for example a four-pointed star, to enhance the aesthetic effect of the setting.

In order to ensure that the stone is set in its upright orientation, the setter may use a tacky material such as Plaszicine® or Blu-Tack® to lift a stone by its upper face and place it into the chamfered hole, which is usually at the centre of the gouged pattern. The tacky material adheres more to the finger of the setter than to the stone, and thus the sliding of the finger away from the stone once positioned in the chamfered hole releases it from said tacky material.

To secure the stone to the metal, a further gouging process is required wherein the setter uses a metal scoop to gouge material from around the hole towards the stone in a manner similar to the scooping of butter curls. In the case where a four-pointed star pattern has been previously gouged around the hole, the setter positions the stone in said hole and gouges metal from between the points of the star in a symmetrical manner. The natural deformation of the metal which results from said scooping is to curl in the direction of and over an edge of the stone, thus securing said edge. The setting process is completed by using a de-burring tool which is simultaneously rotated and urged downwardly onto each of the gouged metal portions which overlie the edges of the stone. Burr resulting from the gouging operation is removed, and the downward pressure on the malleable material deforms the gouged metal portions into small pips which overlie the edges of the stone thus securing it symmetrically in the hole.

The abovementioned process has a number of inherent disadvantages. Firstly, there is a limit to the thickness of the metal which may be used, as thinner metal is likely to be punctured and ruptured by the manual gouging operations, regardless of the skill of the setter, but reducing the thickness of the material is always desirable especially in cases where a large number of lockets, pendants, brooches and the like are produced (of the order of thousands per week), in that a slight reduction in the thickness of the metal of said items may represent a substantial saving in raw material cost for the manufacturer.

A further disadvantage which is inherent in any manual operation is the imprecise nature thereof. More specifically, it is highly unlikely that a setter will achieve an exactly symmetrical stone setting on every single occasion, and in some cases such variation may result in weak setting of the stone with obvious further consequences.

SUMMARY OF THE INVENTION

It is an object of this invention to provide a method of setting a stone in the sheet whereby the skill level required in the setting of stones is reduced, and to improve the consistency and quality of the setting of the stone.

It is a further object of the invention to provide a method for setting stones in malleable material which allows stones to be set in materials of a lesser thickness than previously possible by manual gem setting operations.

The invention also provides an article comprising a small object set in a sheet of malleable material.

According to a first aspect of the invention there is provided a method of manufacturing an article such as item of jewelry, wherein a small object, such as a precious, semi-precious or quasi-precious stone, is set in a sheet of malleable material, such as a precious metal or an alloy thereof, characterised in that prior to the insertion of the object, the sheet is machine or jig worked to be provided with a recess or aperture sized to the size of the small object, and peripherally of the aperture or recess, with two or more projections which project from one face of the sheet, and wherein the small object is deposited in the recess or aperture and a tool presses on the projections which deforms the projections over the edge of the small object to set same in the material.

Preferably, the sheet with the object located therein is held in a jig which is located in a predetermined position in relation to the tool, which is mounted for movement towards the jig to effect the deforming step, and is movable away from the jig after the deforming step to enable the sheet to be removed from the jig.

It is further preferable that the tool comprises first and second portions which are relatively moveable against spring loading, wherein the first portion comprises a pin which engages the small object when the tool is moved to perform the deformation step, and the second portion performs the deformation, after the first portion engages and locates the small object, by sliding relative to the first portion, against the spring loading.

Preferably, the jig defines a support means which engages the rear face of the sheet behind the projections which causes the deforming material to move in a direction to lie over the edge of the small object.

Yet further preferably, there are recesses in the rear face of the sheet behind the projections thereof, and the jig is provided with protrusions which form said support means and protrude into said recesses.

Preferably, the sheet is pressed to define a recess for the object, and the projections.

According to a second aspect of the present invention, there is provided apparatus for manufacturing an article such as an item of jewelry wherein a small object, such as a precious stone, is set in a recess or aperture provided with two or more projections adjacent thereto and in a front face of a sheet of malleable material, such as a precious metal or an alloy thereof, comprising a deforming tool and a jig which may be moved together and apart, the jig being located in a predetermined position in relation to the tool, there being recesses in the rear face of the sheet behind the projections thereof, the jig being provided with protrusions which form said support means and protrude into said recesses, the tool pressing on the projections of the material to deform said projections over the edge of the object when positioned in said recess and said material is positioned on said jig, characterised in that the jig defines a support means which engages the rear face of the sheet behind the projection or projections which causes the deforming material to move in a direction to lie over the edge of the small object.

Preferably the tool comprises first and second portions which are relatively movable against spring loading, the first portion comprising a pin adapted to engage the object deposited in the recess or aperture of the material when the tool is moved to perform the deformation step, and the second portion performing the deformation of the projection or projections over the edge of said object after the first portion engages and locates the small object, by sliding relative to the first portion, against the spring loading.

The invention has advantage in that as the sheet is pre-worked by machine and/jig, stones may now be set in metal of a thickness as low as 0.216 mm (6/1000 of an inch), and possibly lower. Typically, skilled workers are currently capable of setting stones in metal of minimum thickness of the order of 0.590 mm (15/1000 of an inch). It is to be understood that these values of thickness are provided only as a guideline and to demonstrate that the setting of stones according to the invention may now be effected in metal of a substantially lower thickness than by manual methods.

Furthermore, the invention provides a means of setting stones in malleable material quickly and effectively without the requirement for especially skilled labour, and the setting of the stone is generally more secure than that achievable by a skilled craftsman.

The invention also provides an article comprising a sheet of malleable material in which a small object is set, the object being held to the sheet by two or more portions of the sheet pressed out of the sheet and deformed over the edge of the small object.

Preferably, the article is an article of jewelry, the sheet is of precious metal or an alloy thereof, and the small object is a gemstone.

Preferably, the sheet is of a thickness of the order of 0.236 mm.

BRIEF DESCRIPTION OF THE DRAWINGS

A specific embodiment of the invention will now be described by way of example with reference to the accompanying drawings wherein.

DETAILED DESCRIPTION OF THE PREFERRED EMBODIMENT

Figure 1:
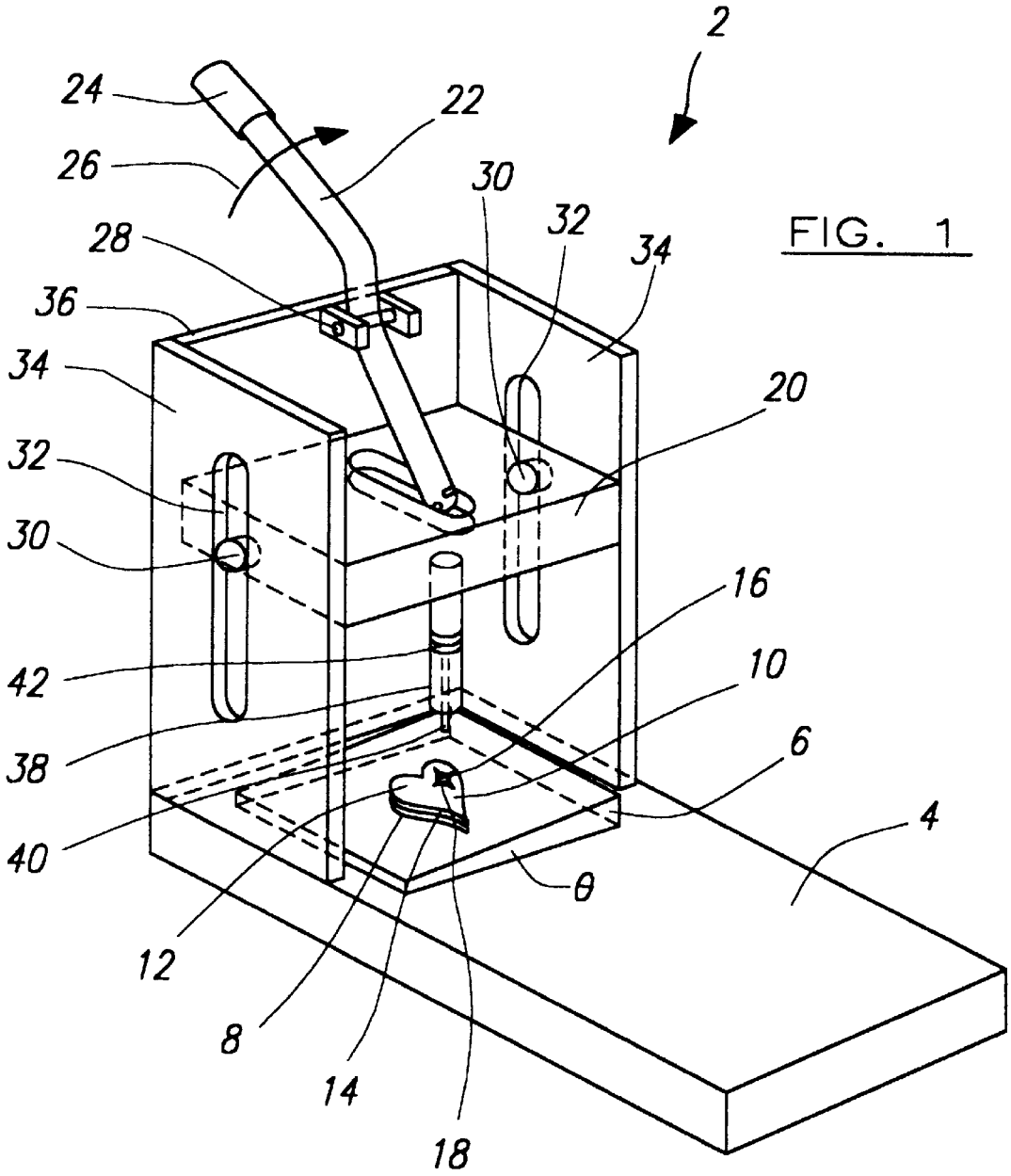
FIG. 1 shows a perspective view of a tool according to the invention.

Referring firstly-to FIG. 1, a gem setting -tool denoted generally at 2 comprises a base plate 4 containing a jig 6 mounted at an angle θ to the plane of the base plate 4. A heart-shaped plinth 8 is mounted on said jig 6 and a similarly shaped pendant 10 with upper face 12 and a lip 14 made of gold or other malleable sheet material is mounted thereon. The pendant 10 is provided with the lip 14 around the extent of its periphery and said lip 14 aids in the positioning of said pendant on said plinth.

Figure 2:
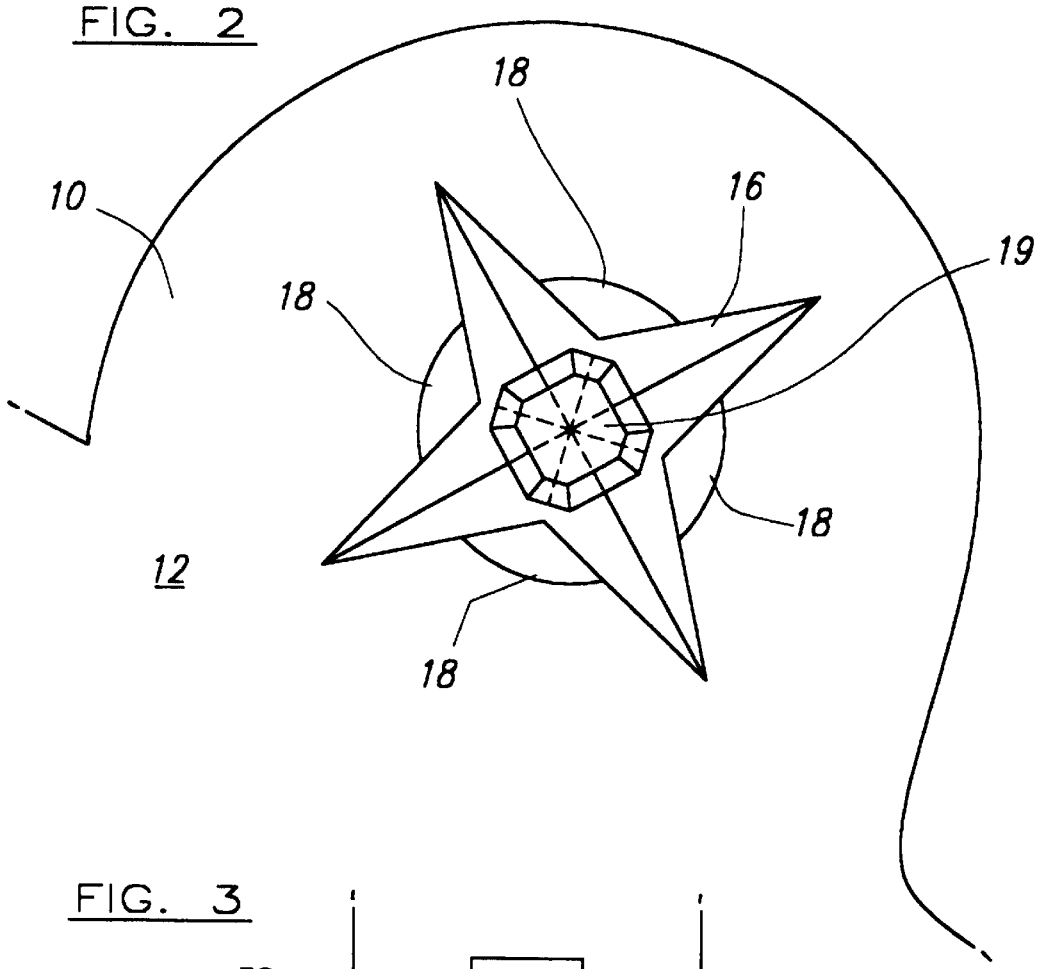
FIG. 2 shows an enlarged plan view of the recess in the malleable material and a gem stone positioned therein.
Figure 3:
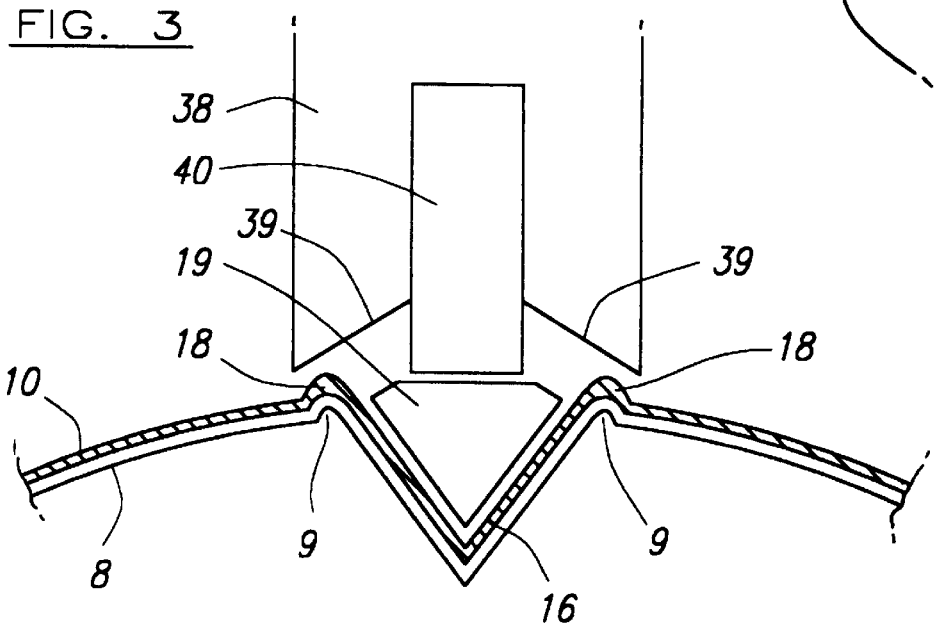
FIG. 3 shows a sectional view of the recess and stone of FIG. 2 prior to the deformation of the projections.

The upper face 12 of the sheet material of the pendant 10 is provided with a star-shaped recess 16 for receiving a suitably sized gem-stone 19 and also with projections, one of which is referenced at 18, which surround said recess. It is to be noted that the sheet of the pendant is pre-formed with the recess prior to inserting the gem 19 (FIGS. 2 and 3). This pre-forming in accordance with the invention is by machine and/or jig working so that the recess will be formed accurately, and more particularly will enable the use of much thinner gauge sheet material, which, if of precious metal or an alloy thereof will be very expensive. It is preferred that the recess and projections be formed simultaneously by pressing the sheet material.

The tool 2 also comprises a vertically moveable plate 20 slidably connected to a handle 22 with a grip 24 which is intended to be operated by a human hand (not shown). Rotation of the handle 22 in the direction shown by arrow 26 about a hinge 28 urges the plate 20 towards the jig 6, and rotation in the alternate direction moves the plate away from said jig. True vertical motion of said plate is ensured by spigots 30 provided on the end faces of the plate 20 and which slide in slots 32 in a pair of end blocks 34 attached both to the base plate 4 and to a back plate 36 of the tool 2.

The vertically moveable plate 20 is provided on its underside with a peg 38 within which a pin 40 is loaded with a spring 42 and is allowed to translate. The base of the peg 38 is chamfered inwardly as shown in FIG. 3 at 39.

Referring to FIG. 2, the star-shaped recess 16 in upper face 12 is shown with gem stone 19 located therein.

With reference to FIGS. 1 and 3, the operation of the tool is now described. A pendant 10 is positioned on the plinth 8 as shown. The plinth is located on the jig 6 to ensure that the pin 40 is directly above the centre of the recess 16 and during operation the pin will contact the upper face of any gem stone located therein. Once such a stone has been deposited in the recess 16 in the correct orientation shown in FIGS. 2 and 3, the handle 22 is rotated and the peg 38 is moved vertically towards the pendant. At a certain point in the vertical travel of the plate 20, and thus the peg 38, the pin 40 comes into contact with the upper face of the gem stone 19 and thus holds it against the bottom of the recess. When the plate 20 is almost at the limit of its downwards vertical travel, the position shown in FIG. 3 is reached. It can be seen from this Figure that the plinth 8 is provided with protrusions 9 which are received by the hollows in the underside of the pendant 10 resulting from the pressing of projections 18. Said protrusions further aid the positioning of the pendant 10 on the plinth 8, but more importantly prevent the metal of the strip from being pushed back into the hollows during the deformation of the projections 18 as will be explained.

Figure 4:
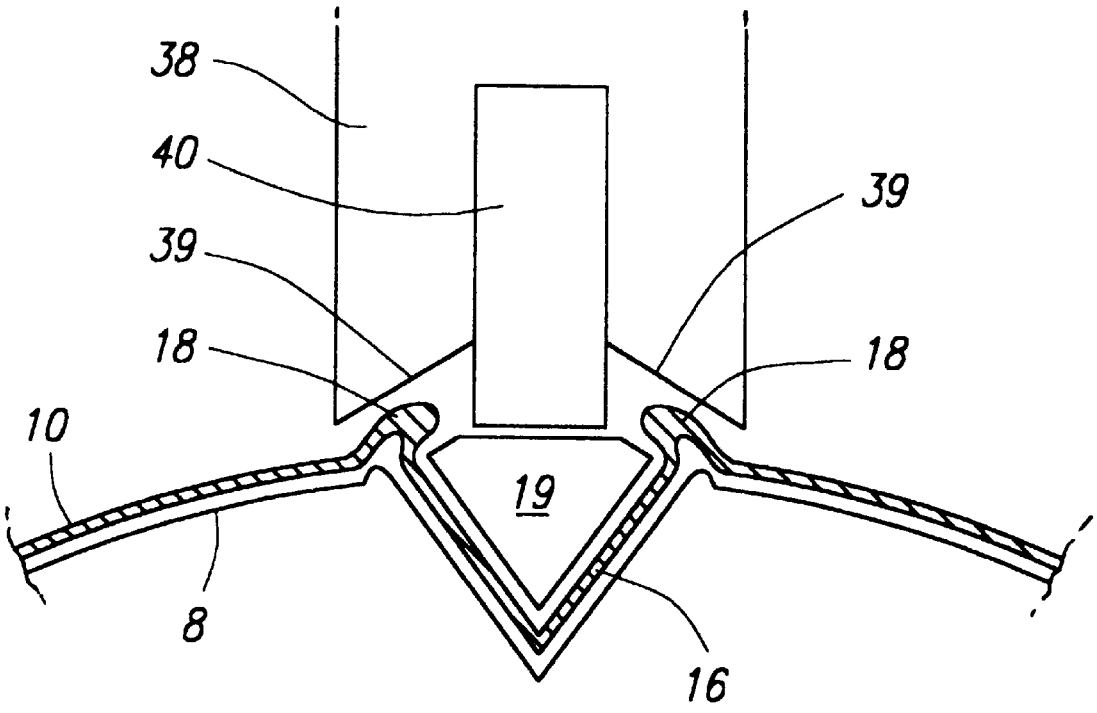
FIG. 4 shows a sectional view of the recess and stone of FIG. 2 after the deformation of the projections.

In the final forming step the pin is forced to its lowermost position as shown in FIG. 4. The diameter of the peg 38 is marginally greater than the diagonal distance between opposing projections 18 such that the chamfered portions 39 of the peg 38 press on the projections and urge them inwardly over the edges of the gem stone 19, trapping it to the sheet. The malleability of the material of the pendant is such that large forces are not required.

The position of the peg and pin immediately after the deformation of the projections 18 is shown in FIG. 4, where it can be seen that the gem stone 19 is secured within the recess 16 by the deformed projections 18 which overlie the edges of said stone.

It will be appreciated that although a hand operated tool has been described herein, any suitable actuation means, for example hydraulic or pneumatic, may be used to move the plate 20 in a vertical direction.

What is claimed is:

1. A method of manufacturing an article comprising a sheet of malleable material in which a small object comprising a precious stone is set, wherein prior to the insertion of the object, the sheet is initially worked to form a recess sized to the size of the small object and one or more projections formed peripherally of the recess and which project from one face of the sheet above the recess, and wherein the small object is deposited in the recess, said sheet being mounted on a jig located in a predetermined relation to a tool mounted for movement towards and away from the jig, said tool comprising a pin relatively moveable within and which protrudes from one end of a peg, a lower surface of the said one end of said peg being inwardly chamfered, the mounting of the tool and the jig ensuring that as the tool moves towards the jig, the pin firstly comes into contact with the stone and clamps the stone in the recess, and secondly the inwardly chamfered lower surface of the peg contacts the one or more projections of the sheet material and deforms the one or more projections over edges of the stone, and wherein the jig is provided with a recess corresponding to and receiving the recess in the sheet material and having at least one or more protrusions, which are received in cavities underneath the one or more projections in the sheet material and which constrain the material during the deforming of the projections of the sheet material over the edges of the stone.

2. The method according to claim 1, wherein said sheet of malleable material which is worked to form a recess comprises a precious metal.

3. The method according to claim 2, wherein said precious metal comprises one of gold and a gold alloy.

4. An apparatus for setting a small stone in a sheet of malleable material provided with a recess having one or more projections adjacent thereto and in a front face of the sheet of malleable material which necessarily has one or more recesses in a rear face of the sheet corresponding to the projections in the front face thereof, wherein the small stone is deposited in said recess prior to setting, said apparatus comprising:

a deforming tool and jig which are movable together and apart, the jig being located in a predetermined position in relation to the tool, the jig being provided with a predetermined number of protrusions which form supports for and protrude into said one or more recesses, the tool being mounted in said apparatus so as to be moveable towards and away from said jig, and the tool comprising a peg in which a pin is mounted and which protrudes from one end of said peg and is moveable axially relative to said peg, the said one end of said peg having an inwardly chamfered surface, said tool being lowered until said inwardly chamfered surface comes into contact with said one or more projections in the front face of the sheet of malleable material, and wherein the predetermined number of protrusions in the jig constrain the material of the sheet in the region of the said one or more projections during the deforming of said at least one or more projections of sheet material over edges of the stone.

5. An apparatus according to claim 4, wherein the mounting of the pin within the peg of the tool is spring loaded to bias the pin outwardly of said peg, the movement of the pin being relative to the Reg when the pin comes into contact with the small stone occurring against the action of the spring.

6. The apparatus according to claim 4, wherein said malleable sheet material having a recess therein comprises a precious metal.

7. The apparatus according to claim 6, wherein said precious metal comprises one of gold and a gold alloy.

* * * * *